US006988825B2

(12) United States Patent
Coville et al.

(10) Patent No.: US 6,988,825 B2
(45) Date of Patent: Jan. 24, 2006

(54) METHOD AND APPARATUS FOR USING VERTICAL MAGNETIC STIRRING TO PRODUCE TURBULENT AND CHAOTIC MIXING IN VARIOUS STATES, WITHOUT COMPROMISING COMPONENTS

(75) Inventors: William E. Coville, Levittown, PA (US); Donald G. Ware, Lansdale, PA (US)

(73) Assignee: Bio/Data Corporation

( * ) Notice: Subject to any disclaimer, the term of this patent is extended or adjusted under 35 U.S.C. 154(b) by 11 days.

(21) Appl. No.: 10/612,161

(22) Filed: Jul. 2, 2003

(65) Prior Publication Data

US 2004/0022123 A1 Feb. 5, 2004

Related U.S. Application Data

(60) Provisional application No. 60/393,638, filed on Jul. 3, 2002.

(51) Int. Cl.
*B01F 13/08* (2006.01)

(52) U.S. Cl. ..... 366/273; 366/343

(58) Field of Classification Search ..... 366/273, 366/274, 343, 144

See application file for complete search history.

(56) References Cited

U.S. PATENT DOCUMENTS 2,852,586 A * 9/1958 Steele ..... 366/273
3,356,346 A * 12/1967 Landsberger ..... 366/274
3,622,129 A * 11/1971 Mazowski ..... 366/247
3,680,843 A * 8/1972 Lu et al. ..... 366/273
3,724,820 A * 4/1973 Bonjour et al. ..... 366/273
3,749,369 A * 7/1973 Landsberger ..... 366/273
4,040,605 A 8/1977 Towsend
4,090,263 A * 5/1978 Hoffa ..... 366/273
4,131,370 A * 12/1978 Lawrence et al. ..... 366/273

(Continued)

OTHER PUBLICATIONS

Olivier Ubrich, "Choosing The Right Stirrer for RC1 Studies", Mettler–Toledo GMbH, Schwerzenbach, Feb. 2, 2002, 6 pages.*
Visualization of Three Dimensional Chaos, J.M. Ottino, Science Jul. 31, 1998, vol. 281, pp. 683–686.
Principles for Industrial Mixing, H. Venkitachalam, 38 pages, no date.
Research Trends and Updates, Rutgers Chemical and Biochemical Engineering, Fluid Mechanics Transport Phenomena F. Muzzio, Fall 2002, 4 pages.
"Ancillary Equipment: Model 303A Static Mercury Drop Electrode" 3 pg, no date.
Bio/Data Corporation, "Imixx: Vertical Stirring System MVS–2", 1 pg, no date.
V&P Scientific, Inc., "The Concept is Simple . . . " Feb. 2001, 2 pg.
"Miniature Magnetic Stirring Kit" Jun. 2001, 1 page.

*Primary Examiner*—Tony G. Soohoo
(74) *Attorney, Agent, or Firm*—Volpe and Koenig, P.C.

(57) ABSTRACT

Vertical electromagnetic stirring is used to produce low shear, stress, turbulent and chaotic mixing of a liquid material or suspension in a container regardless of the volume or container geometry. Movement of a magnetic stir bar is controlled by multiple magnetic fields. The magnetic fields are produced by a series of sequentially or non-sequentially activated inductor coils which produce asymmetrical stirring dynamics and random motions of the stir bar, causing the liquid material to be gently and effectively mixed throughout the container. Moving the stir bar in random and irregular patterns during the stirring operation creates turbulent and chaotic mixing dynamics. The stir bars used for supporting vertical magnetic stirring are specifically designed to optimize the effectivity of the mixing process by maximizing the length of the stir bar to quickly and gently mix the materials.

36 Claims, 15 Drawing Sheets

U.S. PATENT DOCUMENTS 4,162,855 A 7/1979 Bender
4,199,265 A * 4/1980 Sanderson et al. ..... 366/274
4,209,259 A * 6/1980 Rains et al. ..... 366/273
4,484,615 A * 11/1984 Melford et al. ..... 164/504
4,491,819 A 1/1985 Ray
4,498,785 A * 2/1985 de Bruyne ..... 366/274
4,534,656 A * 8/1985 de Bruyne ..... 366/273
4,568,195 A * 2/1986 Herz et al. ..... 366/274
4,759,635 A * 7/1988 MacMichael et al. ..... 366/274
4,911,555 A 3/1990 Saffer et al.
4,911,556 A * 3/1990 Lim et al. ..... 366/279
4,991,973 A * 2/1991 Maaz et al. ..... 366/274
5,222,808 A 6/1993 Sugarman et al.
5,513,912 A 5/1996 Lotz et al.
5,529,391 A * 6/1996 Kindman et al. ..... 366/274
5,533,800 A 7/1996 Stiegelmann et al.
5,547,280 A 8/1996 Wanninger et al.
5,549,382 A * 8/1996 Correia et al. ..... 366/144
5,556,067 A 9/1996 Konig et al.
5,795,061 A 8/1998 Perlman
5,899,567 A 5/1999 Morris, Jr.
6,033,574 A 3/2000 Siddiqi
6,176,609 B1 * 1/2001 Cleveland et al. ..... 366/273
6,236,590 B1 * 5/2001 Bhattacharyya et al. .... 365/173
6,247,840 B1 * 6/2001 Gaffar ..... 366/274
6,357,907 B1 3/2002 Cleveland et al.
6,483,736 B2 * 11/2002 Johnson et al. ..... 365/130
6,525,953 B1 * 2/2003 Johnson ..... 365/63
6,631,085 B2 * 10/2003 Kleveland et al. ..... 365/175
6,635,492 B2 * 10/2003 Gunter ..... 436/174
6,733,171 B2 * 5/2004 Schob ..... 366/273
2002/0118594 A1 * 8/2002 Vellinger et al. ..... 366/273

* cited by examiner

* AREAS OF INCOMPLETE STIRRING

* AREAS OF INCOMPLETE STIRRING

SYMBOL KEY:

\\ FRONTAL WAVE o NEGATIVE PRESSURE

>> LIQUID FLOW

BAR ROTATION

In all configurations, coils A and C, B and D oppose each other.

Full Power, Single Step (centered magnet)

| Rotation Angle | Coil A | | Coil B | | Coil C | | Coil D | |
|---|---|---|---|---|---|---|---|---|
| 0 | + | - | | | - | + | | |
| 90 | | | + | - | | | - | + |
| 180 | - | + | | | + | - | | |
| 270 | | | - | + | | | + | - |

FIGURE 6A

Full Power, Single Step (magnet along wall of vial)

| Rotation Angle | Coil A | | Coil B | | Coil C | | Coil D | |
|---|---|---|---|---|---|---|---|---|
| 0 | + | - | | | | | | |
| 90 | | | + | - | | | | |
| 180 | | | | | + | - | | |
| 270 | | | | | | | + | - |

FIGURE 6B

Full Power, Half Step (centered magnet)

| Rotation Angle | Coil A | | Coil B | | Coil C | | Coil D | |
|---|---|---|---|---|---|---|---|---|
| 0 | + | - | | | - | + | | |
| 45 | + | - | + | - | - | + | - | + |
| 90 | | | + | - | | | - | + |
| 135 | - | + | + | - | + | - | - | + |
| 180 | - | + | | | + | - | | |
| 225 | - | + | - | + | + | - | + | - |
| 270 | | | - | + | | | + | - |
| 315 | + | - | - | + | - | + | + | - |

FIGURE 7A

Full Power, Half Step (magnet along wall of vial)

| Rotation Angle | Coil A | | Coil B | | Coil C | | Coil D | |
|---|---|---|---|---|---|---|---|---|
| 0 | + | - | | | | | | |
| 45 | + | - | + | - | | | | |
| 90 | | | + | - | | | | |
| 135 | | | + | - | + | - | | |
| 180 | | | | | + | - | | |
| 225 | | | | | + | - | + | - |
| 270 | | | | | | | + | - |
| 315 | + | - | | | | | + | - |

FIGURE 7B

Sinusoidal Drive (centered magnet)

| Rotation Angle Ø | Coil A Sin Ø | Coil B Sin (Ø – 90) | Coil C Sin (Ø – 180) | Coil D Sin (Ø – 270) |
|---|---|---|---|---|
| 0 | 0 | Min | 0 | Max |
| 45 | .707 | .707 | -.707 | .707 |
| 90 | Max | 0 | Min | 0 |
| 135 | .707 | .707 | .707 | -.707 |
| 180 | 0 | Max | 0 | Min |
| 215 | -.707 | .707 | .707 | .707 |
| 270 | Min | 0 | Max | 0 |
| 315 | .707 | -.707 | .707 | .707 |

Max = maximum positive drive level possible.

Min = maximum negative drive level possible.

FIGURE 8

METHOD AND APPARATUS FOR USING VERTICAL MAGNETIC STIRRING TO PRODUCE TURBULENT AND CHAOTIC MIXING IN VARIOUS STATES, WITHOUT COMPROMISING COMPONENTS

CROSS-REFERENCE TO RELATED APPLICATIONS

This application claims the benefit of U.S. Provisional Application No. 60/393,638, filed Jul. 3, 2002.

BACKGROUND OF THE INVENTION

Contemporary research, life science and other analytical and process laboratories must mix liquids and suspensions to activate, chemically combine and promote cellular or molecular interactions. Mixing is a basic operation applied to all forms and manners of engineered material processing including those used in biological, chemical, pharmaceutical, fermentation, agricultural, petrochemical, and cosmetic processes. Micro-liter (less than 1.0 milliliter) to multi-liter volumes must be mixed. Operations on large or small volume samples require precise, repeatable and controlled mixing and heating for accurate and reproducible results.

Stirring and mixing have been identified as a problem because mixing is incomplete and homogeneity is not attained. This causes further processing errors due to sampling in or between concentration layers, which are not indicative of the materials being mixed. The result is random variation in the process operation and variability and waste in the resulting product. Mixing is a fundamental diffusion process. It is not reversible. Stirring is a mechanical process often used to cause mixing. Stirring may be reversible by natural forces such as gravity, or other imposed forces. When used, effective stirring is essential for thorough mixing. Effective stirring requires physical contact between the materials to be mixed which can not be duplicated by agitating, flicking, vortexing, gassing, rocking, shaking or rolling vessels containing materials to be mixed.

Mixing operations in all volumes require complete mixing. Small volumes in particular, require more complete, and controlled mixing to produce accurate and reproducible results or maximum yield without damaging or otherwise artifactually changing the ingredients.

The basis of this problem is that the present methods develop regular, predictable and symmetrical flow patterns within the liquid or materials being mixed. There are regions that are partially mixed or unmixed and there is a concentration related layering of reactants, some of which are over mixed. Further, it is now known that effective mixing can only be achieved if the flow patterns are disrupted or randomly changed. Existing theories and mixing models do not accurately describe mixing processes and limitations.

Methods used to mix volumes of liquids are based on stirring with paddles, rotating impellers, blades, magnetic bars, or by rocking, rolling, shaking, or vortexing the entire container. All of these methods create symmetrical stirring dynamics, but incomplete mixing because the adjacent materials move in a symmetrical way, in unison and move in a manner that does not include all portions of the material to be mixed. Therefore, mixing is incomplete and homogeneity or maximum yields are not attained. The result is uncontrolled variations in the process operation and variability and waste in the resulting product. Current practice uses baffles either mounted on the container wall or suspended into the container, to disrupt these regular mixing patterns. These baffles are minimally effective, causing only regular and symmetrical patterns. Another practice is utilizing variable pitch impellers to change the mixing patterns. This method will modify the pattern, but the pattern remains because the impeller is still rotating on the same axis. Mixing is a fundamental operation in all forms of material processing. Methods used to mix materials are based on standard physical characteristics of the materials to be mixed including volumes, viscosity, Reynolds number, Schmidt number, vessel geometry, and temperature.

FIG. 1A shows a conventional magnetic stirring technique using a motor 110 that rotates a permanent magnet 115, causing stir bar 105 to move at the bottom of container 120. The motor and magnet are normally located below a platform on which the samples to be mixed are placed. The stirring speed (rpm) is often controlled by a potentiometer (not shown) that varies the voltage to the motor 110. As shown in FIG. 1B, the stirring speed is selected by visibly observing the stir bar capture and stirring dynamics (see flow patterns 125) in the container 120. These conventional techniques have only a limited effect in areas of the liquid that are not close to the stir bar, baffles or impeller. Rocking, shaking or rolling moves the liquid in unison, which limits the interaction of the materials, and also has limited mixing in the center, corners and along the walls of a container. FIG. 1C shows a conventional electromagnetic stirring technique by applying an electrical current to coils 130, which generate an electromagnetic field. The stir bar 105 moves in a horizontal, rotating motion at the bottom of container 120 in response to the electromagnetic field.

FIG. 1D shows a conventional motor driven impeller stirring technique using a motor 110 that rotates an impeller 150 via rotating shaft 145 to mix a liquid material in container 120. This method has inherent contamination disadvantages due to the proximity of the motor, seals and bearings that are associated with the shaft along with cleaning difficulties of all of the components.

Mixing with typical symmetrical patterns and lack of mixing in some areas causes the liquids, or liquids and solids, to move about the container relative to one another, rather than colliding with or diffusing into each other. These methods do not cause the required total exposure and frequent collision with the components being mixed. It is known that symmetrical mixing patterns do not involve the entire volume of the container and do not produce efficient or complete mixing regardless of the length of time mixed. A number of concentration layers exist, which demonstrate the inability of these methods to reach a homogenous state. It has also been demonstrated that turbulent currents and chaotic stirring dynamics enhance the mixing and are essential to attain homogeneity or complete interaction between the materials being mixed. The turbulent element disrupts these patterns and provides enhanced collision and exposure of the components being mixed. It is also known that a stirring device must involve the entire volume to produce effective mixing.

Conventionally positioned horizontal stir bars or impellers can only vary speed, geometry or stirring time and have limited effect in areas of the liquid that are not close to the stir bar or impeller. Rocking, shaking or rolling moves the liquid in unison, limits the interaction of the materials, and also there is limited mixing in corners and along the walls of the container, and near the meniscus or upper most portion of the liquid. These methods rely on high stirring speeds to improve the mixing in areas away from the stirring device, stir bar or impeller. The increased mechanical forces, such as shear, vortexing and cavitations, cause cellular or other fragile components in the liquid or sample to be altered, activated or physically compromised. This is especially important when stirring plant or animal cells, other organisms such as bacteria or viral specimens and proteins, labile molecules or long chain chemicals.

What is needed is an efficient, gentle mixing technique that produces effectively mixed liquids in a container by producing asymmetrical mixing patterns that involve the entire volume of the container without changing of constituents.

SUMMARY

The present invention uses a technique that produces gentle chaotic stirring dynamics to affect the entire volume of a liquid in a container, while not inducing extreme mechanical forces on the material being mixed, and reducing the time to reach homogenety.

Vertical stirring is attained by using a stir bar that is comprised of a permanent magnet and has a length that is greater than the internal diameter of smaller containers. This stir bar length positions the stir bar generally vertically in the container. In larger volume applications, the stir bar is buoyant to assume a vertical position. Inducing movement of the stir bar by multiple magnetic fields to produce various stirring patterns and selectable multidimensional motions provides gentle and efficient mixing throughout the container. Moving the stir bar in regular and irregular patterns during the low speed stirring operation creates chaotic material movement and turbulence needed for complete mixing throughout the liquid.

A stir bar of appropriate dimensions directly stirs the entire depth of the liquid. The longer stir bar produces greater liquid motion per unit motion of the stir bar. This method is applicable for liquid volumes from micro-liters to liters and any container shape, including 'V', flat or round bottom micro tubes or other vessels. The configuration of the stir bar (e.g., elongated, angled, round, etc.) provides features that enhance the stirring action that cause turbulent and chaotic mixing. The electromagnetic drive provides the flexibility of controlling and changing the stirring dynamics during the stirring process to create chaotic mixing.

The vertical stirring method emulates the original glass rod stirring that was used prior to the mechanization of stirring. This manual operation, although unknown at the time, produced irregular turbulent, chaotic mixing through the entire depth of the liquid.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments, which are presently preferred. It should be understood, however, that the invention is not limited to the precise arrangements and instrumentalities shown. In the drawings:

FIGS. 6A and 6B show the polarities used for energizing the inductor coils at single step rotational angles to create magnetic fields in accordance with the present invention;

FIGS. 7A and 7B show the polarities of current applied to the inductor coils at half step rotational angles to create magnetic fields in accordance with the present invention;

FIG. 8 shows the sinusoidal drive of the inductor coils used to create magnetic fields in accordance with the present invention;

DETAILED DESCRIPTION OF THE PREFERRED EMBODIMENTS

Figure 1A:
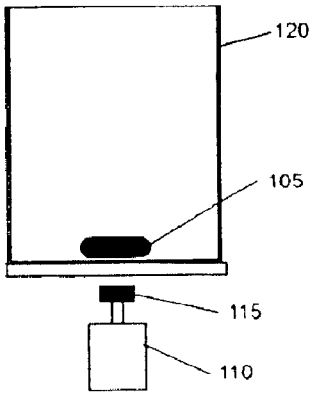
FIGURE 1A (PRIOR ART)
FIG. 1A shows a conventional magnetic stirring technique using a motor and permanent magnet.
Figure 1B:
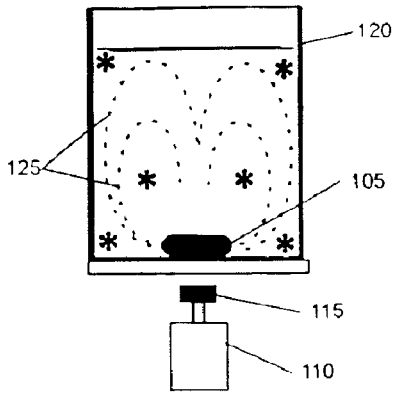
FIGURE 1B (PRIOR ART)
FIG. 1B shows the resulting flow dynamics of the technique of FIG. 1A.
Figure 1C:
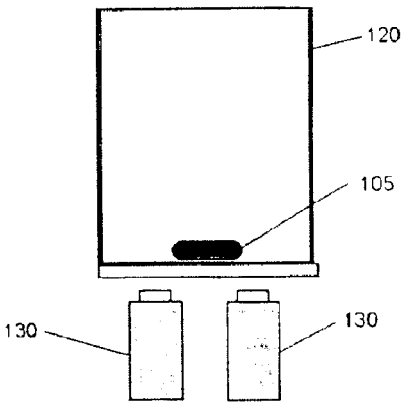
FIGURE 1C (PRIOR ART)
FIG. 1C shows a conventional electromagnetic stirring technique using coils which generate fixed or constant magnetic fields
Figure 1D:
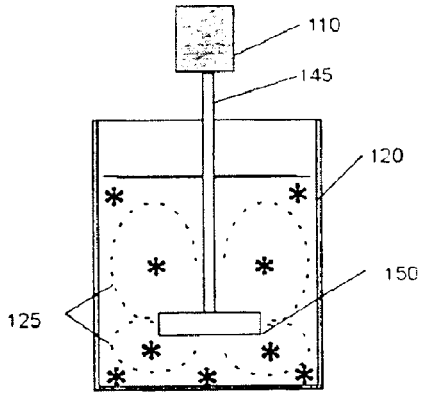
FIGURE 1D (PRIOR ART)
FIG. 1D shows a conventional stirring technique using an impeller rotated by a motor, and the resulting dynamics.

The unique elements of the present invention are:

(1) Vertical stirring;

(2) Random asymmetrical stirring producing turbulent, chaotic mixing;

(3) Low speed gentle stirring producing minimal stress and shear while effectively mixing;

Direct mixing of microvolumes, 0.2–50 mL, to multi-liter volumes (4) Magnetic stir bars and assemblies include:

(a) a suspended stir bar, (b) a floating stir bar, (c) particular stir bar shapes, disposable stir bars, and coated and/or sterile (d) particular stir bar assembly shapes;

straight tublar, flexiable, small diameter curved rods etc.

Inter-changeable incubation blocks with multiple wells for improved temperature control of the container.

(4) Using a simulator to determine the effectiveness of various stirring techniques while allowing the visual observation and documentation of the stirring dynamics; and (5) Temperature control utilizing the heat developed by magnetic coils used to generate magnetic fields, and fans, to maintain precise temperature control.

1. Vertical Stirring

Vertical stirring is attained by, using a magnetic stir bar that is configured to a length and/or buoyancy that positions the stir bar generally vertically in the container as compared to stir bars that lie horizontally on the bottom of the container. Inducing movement by multiple magnetic fields to produce various stirring patterns and motions (e.g., up, down, etc) which provide efficient mixing throughout a container. Moving the stir bar in both regular and irregular patterns during the stirring operation creates turbulent and chaotic mixing. A method is provided of stirring liquids, mixtures, emulsions, slurries and suspensions thoroughly and efficiently, at low speeds with chaotic mixing, in any container, regardless of the shape or volume. Random variations in the stirring motion, provides efficient mixing by producing turbulent and chaotic mixing dynamics. The vertical stir bar length and configuration enhance the effectivity of the stirring action through the entire volume, reducing stirring time.

The first advantage of vertical stirring is that the length of the stir bar induces mixing through the greater portion of the volume of the liquid. This affects the entire volume of the liquid, unlike the conventional techniques previously discussed. More liquid displacement per revolution means more effective stirring at fewer revolutions, or slower stirring speeds. This allows for gentler and slower stirring action, which is performed quicker and minimizing shear and physical stresses. The length of the stir bar should be at least one half of the liquid depth, but may extend above the liquid.

When the stirring action is randomized, the mixing effects are substantially greater. The longer stir bar directly stirs the greater portion of the volume of the liquid in the container. Utilizing magnetic drives, the stir bar can be moved through the entire volume of liquid.

A second advantage is this method works for liquid volumes ranging from microliters to liters. There are no demonstrable upper or lower limits for volumes. This method is applicable for direct stirring of micro-volume or conical shaped containers, for which there are currently no direct stirring methods and for liter or multi-liter volumes where shear or mechanical stresses may be detrimental to the mixing operation.

Vertical stirring with external magnetic fields allows the position and pattern of the stir bar to change, move around randomly within the container, change speeds, reverse direction, and change stirring actions from rotating to linear or vertical or combinations thereof.

The stir bar configuration can incorporate features that additionally enhance the mixing, eliminate artifactual changes or contamination due to the stir bar, or participate in the reaction process. These stir bars are intended to be disposable, eliminating contamination. The configurations may be a simple round, square, ribbed, angled or fluted rod, or include complex fins that change the mixing pattern. The variations are too numerous to be fully detailed in this description, but will be appreciated by the skilled artisan based on the present disclosure.

2. Stir Bars

Figure 2A:
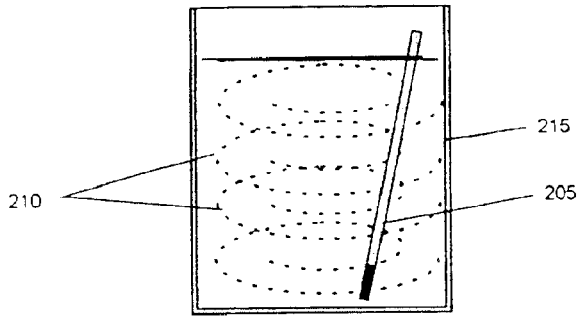
FIG. 2A shows a technique using external magnetic fields to move stir bars vertically through the entire volume of liquid in a container in accordance with the present invention.
Figure 2B:
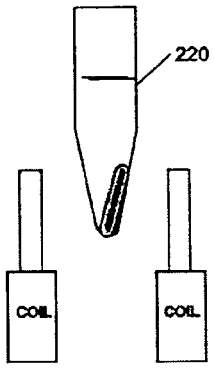
FIG. 2B shows a technique using external magnetic fields to move a stir bar vertically through the entire volume of liquid in a conical tube in accordance with the present invention.
Figure 2C:
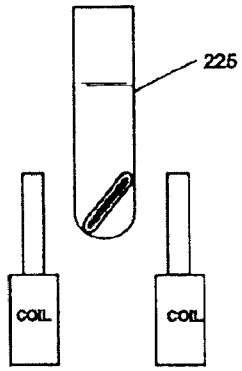
FIG. 2C shows a technique using external magnetic drives to move a stir bar vertically through the entire volume of liquid in a round bottom tube in accordance with the present invention.
Figure 2D:
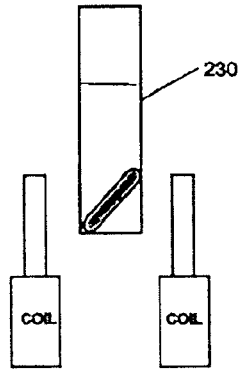
FIG. 2D shows a technique using external magnetic drives to move a stir bar vertically through the entire volume of liquid in a flat bottom tube in accordance with the present invention.
Figure 2E:
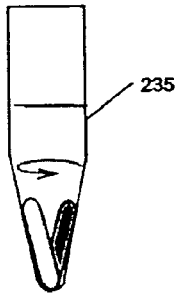
FIG. 2E shows a technique using external magnetic drives to move a "V" pattern of stir bars vertically through the entire volume of liquid in a conical bottom tube in accordance with the present invention.
Figure 2F:
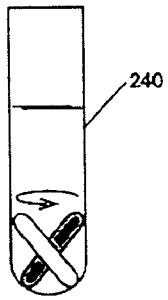
FIG. 2F shows a technique using magnetic drives to move an "X" pattern of stir bars vertically through the entire volume of liquid in a round bottom tube in accordance with the present invention.
Figure 2G:
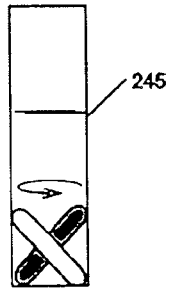
FIG. 2G shows a technique using magnetic drives to move an "X" pattern of stir bars vertically through the entire volume of liquid in a flat bottom tube in accordance with the present invention.

There are several embodiments for applying vertical stirring in accordance with the present invention. FIG. 2A shows a technique using external magnetic fields to move stir bars positioned vertically through the entire volume of liquid in a container. FIG. 2B shows a technique using external magnetic fields to move a stir bar positioned vertically through the entire volume of liquid in a conical tube. FIG. 2C shows a technique using external magnetic drives to move a stir bar positioned vertically through the entire volume of liquid in a round bottom tube. FIG. 2D shows a technique using external magnetic drives to move a stir bar positioned vertically through the entire volume of liquid in a flat bottom tube. FIG. 2E shows a technique using external magnetic drives to move a "V" pattern of stir bars positioned vertically through the entire volume of liquid in a flat bottom tube in accordance with the present invention. FIG. 2F shows a technique using magnetic drives to move an "X" pattern of stir bars positioned vertically through the entire volume of liquid in a round bottom tube in accordance with the present invention. FIG. 2G shows a technique using magnetic drives to move an "X" pattern of stir bars positioned vertically through the entire volume of liquid in a flat bottom tube. For small volumes, the stir bar length is selected such that the stir bar is positioned near vertically and at a slight angle. The length is a variable dependent on the liquid depth. This is applicable for conical bottom tubes as well as round or flat bottom sample tubes up to 13 mm diameter.

Figure 3A:
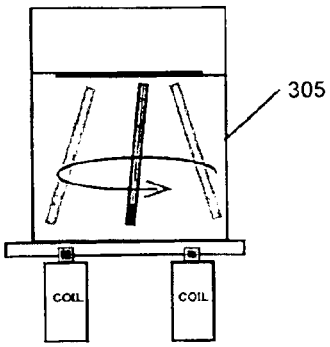
FIG. 3A shows a vertical magnetic stirring technique using a floating vertical stir bar in accordance with one embodiment of the present invention.

FIG. 3A shows one embodiment 305 where, in a vial, beaker or flask, a straight vertical stir bar includes a floating element that suspends the stir bar in the liquid. The application of the floating element adds greater horizontal motion to the stirring action, where the stir bar can move about the container and has a spinning action. The buoyant or floating stir bar moves in irregular patterns where the magnet end attracted to the drives pulls the remainder of the stir bar along and the top of the bar "wobbles" and rocks differently with each step of the drive.

Figure 3C:
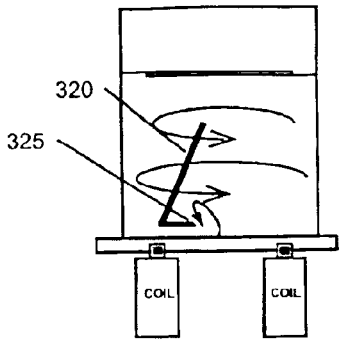
FIG. 3C shows a vertical magnetic stirring technique using an "L" shaped floating vertical stir bar in accordance with one embodiment of the present invention.
Figure 3B:
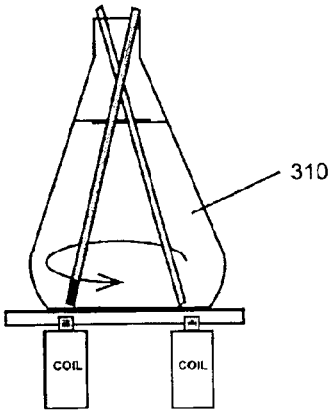
FIG. 3B shows a vertical magnetic stirring technique using a standing vertical stir bar in accordance with one embodiment of the present invention.

FIG. 3B shows another embodiment where the vertical stir bar assembly in a vial or flask that extends the length of the stir bar into the neck of the flask, holding the stir bar vertical.

In constant volume applications, where the liquid volume is not reduced or changed during the mixing, a long stirrer is most applicable. The length of the stirrer should be at least half to equal to the liquid depth. The magnetic end of the stirrer should rest on or float slightly above the bottom of the container. In variable volume applications where liquid is removed or added to the container, a short stirrer is most applicable. This allows the stir bar to float in various volumes of liquid.

An "L" shaped design functions best when the stirring action must lift a liquid or solid off of the bottom of the container. FIG. 3C shows an "L" shaped stirring bar. The vertical leg 320 of the "L" shaped stirring bar includes the floating element constructed from a thin wall inert or biocompatable plastic material, such as a polypropylene tube or similarly inert material. This provides a very light stirrer, which reduces shear stress and crushing damage to the material being stirred. The horizontal leg 325 of the "L" shaped stirring bar contains a magnet. The horizontal leg "sweeps" the bottom of the container in an irregular manner and moves particles up into the liquid. This stir bar also moves in irregular patterns where the magnet end attracted to the drives pulls the remainder of the stir bar along and the top of the bar "wobbles" and rocks differently with each step of the drive. If the application is a volume reduction application, the stirrer should start at one half of the liquid depth and both legs should be less than the internal diameter of the container so it can lie down and stir until the container is nearly empty. If it is a volume addition application, the stirrer should start at or above the volume depth and end up at about one half of the liquid depth. The length of the horizontal leg 325 is generally just long enough to house the magnet and should not be greater than ½ to ¾ of the internal container diameter. This allows for more asymmetrical stirring action. Additionally, the "L" shape in one embodiment is flexible and can be formed at various angles other than 90° and the vertical leg 320 can be formed into various shapes that enhance the stirring action.

The other variable to these stirrers is the diameter of the stirrer. Small diameters will mix smaller volumes well. Larger volumes require larger diameter stirrers. For example, a 2.5 mm diameter is required to stir a 25 mm diameter container, and a 4 or 6 mm diameter stirrer is required to stir a 100 mm diameter container.

In applications where a stronger stirring action is necessary to re-suspend materials from the bottom of the container, an "L" shaped stirrer made of a heavy wall polypropylene or similarly inert material has proven effective. The stirrer must be lighter than the liquid it displaces so it will remain vertical. Rare earth magnets and high power inductor drives increase the strength of the stirring action.

Figure 3D:
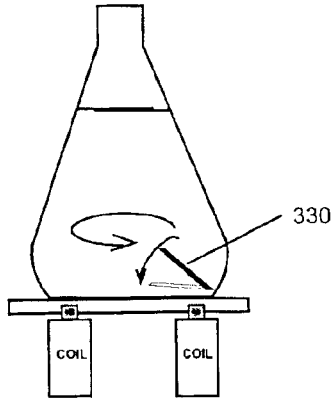
FIG. 3D shows a vertical magnetic stirring technique using a short stir bar that floats at an angle of approximately 45° in accordance with one embodiment of the present invention.

Another variable volume stirrer is a short straight tube 330 that floats at an angle of approximately 45° (see FIG. 3D). The action of this stirrer is rotational and vertical, being drawn by the magnetic fields as the higher end is attracted and repelled by the magnetic fields. This rotating and rocking action creates turbulence and mixing. This stirrer generally works best when it is ¼ to ½ the diameter of the container and is independent of the liquid depth. This usually mixes best in 50 ml volumes or greater.

Variations to the shape and size of the stir bar will cause erratic stirring without changing the electromagnetic drive sequence. Long stir bar assemblies will sometimes require additional weights to position the stir bar at or near the bottom of the container. The position of these weights and magnet will change the balance of the stir bar thus changing the motion of the stir bar as it moves about the liquid. The addition of an eccentric weight or a non-symmetrical shape will cause erratic stirring patterns. The length of a floating stir bar imparts different affects on the stirring action. The end of the stir bar below the liquid surface will stir differently than a stir bar that extends through the surface, directly mixing the meniscus without a vortexing effect.

Stir bars also rotate about their central axis as they move about in the circular motion, in this case a secondary mixing action can be initiated with ribs, flutes or other physical features along the length of the stir bar.

In yet another embodiment, in a vial, beaker or flask, the vertical stir bar may rest on the bottom of the container or be suspended either mechanically or magnetically above the bottom of the container as described above.

In yet another embodiment, such as in a vial, beaker or flask, the vertical stir bar may be hollow and serve as a conduit to deliver materials to the liquid at or near the bottom of the container or be used to withdraw samples, without contamination or need for separate ports.

Magnetic stir bars are an essential component of the present invention. The stir bar length, width or diameter, shape, material, buoyancy and coating can affect the stirring dynamics and the reaction or process. Also, the magnet for most applications will be coated with a variety of inert, biocompatible or application specific materials such as Parylene®, Teflon®, polyethylene, polypropylene, etc. For certain applications, it is required that the stir bar be sterilized, or free of contaminates.

The stir bar configuration can incorporate features that additionally enhance the mixing. In small volume applications the stir bar is a shaped magnet. In larger volume applications the magnet length is augmented with an extension. It is preferred that the overall length be greater than half of the liquid depth in the container. This is application dependent, but generally the longer the stir bar, the gentler the mixing and the less time required to completely mix the materials.

Figure 4A:
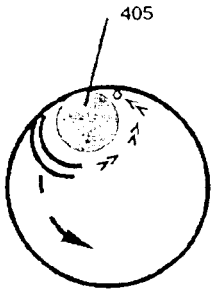
FIG. 4A shows a round stir bar and the resulting dynamics in accordance one embodiment of the present invention.
Figure 4B:
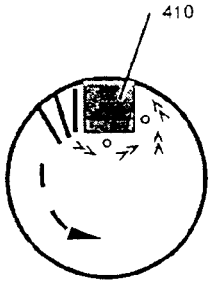
FIG. 4B shows a square stir bar and the resulting dynamics in accordance one embodiment of the present invention.
Figure 4C:
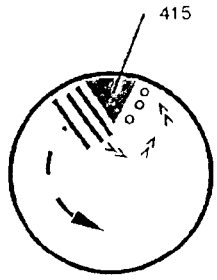
FIG. 4C shows a triangular shaped stir bar and the resulting dynamics in accordance one embodiment of the present invention.

The stir bar must be selected to perform with the container size and shape, liquid volume, viscosity and particle size. FIGS. 4A, 4B and 4C show the basic shapes (cross section) of the stir bars, including round (cylindrical) 405, square (rectangular) 410 and triangular 415. Each stir bar length and shape must suite the container geometry. The stirring dynamics introduced by the basic stir bar shapes will now be described.

The round stir bar as described in the example above provides complete mixing and low shear or gentle stirring. The shape causes the liquid to easily flow around the diameter of the stir bar; cellular or labile molecules are not damaged. This is desirable when cellular material or fragile or labile biomolecules must be mixed. It may also be used to maintain cellular suspensions optimizing the cell/nutrient exposure for enhanced growth of the cultures.

The application of a square stir bar increases the magnitude of these dynamics. The square stir bar pushes with a flat surface, which moves a larger volume of liquid than a round stir bar. The flow of the liquid around the corners of the stir bar produces more force than a round stir bar. This increases the turbulence and chaotic forces that develop the eddy currents and cavitations needed for moderately strong mixing applications such as mixing to form an emulsion or mixing of viscous materials. These two dynamics occur at both edges of the stir bar. Square corner stir bar designs, moving at mid to high range revolutions per minute, causes greater physical forces in the liquid.

A triangular shaped stir bar provides the greatest turbulence and chaos resulting in negative pressure, shear forces, eddy currents and cavitations. This stir bar configuration pushes a larger volume of liquid. The liquid flows rapidly across the face of the triangle, away from the stir bar. This causes the greatest negative pressure because the liquid is flowing away from the stir bar. This negative pressure results in increased eddy currents and cavitations. In turn this will cause the most physical forces in the liquid. At high speeds this can facilitate cell disruption required by certain processes or protocols.

Stirring volume is a result of the stir bar surface area pushing the liquid. The surface area is the width of the stir bar times the length of the stir bar. As described above, a flat surface will push more liquid than the round surface, resulting in more physical movement in the liquid. Variables in the stirring dynamics besides the stir bar size and shape are the container size and shape, liquid volume, viscosity, temperature and particle size.

The size and shape of stir bars affects the stirring dynamics. Each container size and shape causes variations of the stirring dynamics, however, vertical stirring overcomes this limitation. Stir bars that pass through the surface of the liquid stir differently than a stir bar that is shorter than the depth of the liquid. A stir bar in a conical tube (see FIG. 2E, technique 235) will stir in a "V" pattern. A stir bar in a flat (see FIG. 2G, technique 245) or round bottom tube or vial (see FIG. 2F, technique 240) will stir in an "X" pattern.

In containers with depths greater than 20 mm or diameters greater then 8 mm, the stir bar length must be augmented. The 2 mm diameter magnets' preferred maximum length is approximately 10 mm. The preferred method of extending the length is with a material or element that will float or a small diameter (0.040–1.0 mm) extension. This can be implemented in several ways. The advantage is that the stirring element has a vertical element that will affect at least half of the height of the liquid volume for more effective stirring at lower speeds.

In larger volumes, the stir bar may be suspended from the top of the container or float within the liquid. A suspended stir bar will stir in an irregular inverted "V" pattern moving from inductor to inductor and dependent on the inductor pattern. A stir bar that is buoyant will travel in an irregular pattern as it moves around the entire container. The drive inductor pattern can be concentric circles that are sequenced to cause circular mixing patterns about the container. This stir bar also moves in irregular patterns where the magnet end attracted to the drives pulls the remainder of the stir bar along and the top of the bar "wobbles" and rocks differently with each step of the drive. The magnetic drive can also induce a controllable vertical motion when the stir bar floats above the container bottom and is attracted down by the magnetic field and then released or repelled. A stir bar moving vertically, vertical agitation, in a tall, narrow container such as a test tube mixes better when the diameter of the stir bar has a flange or fingers radiating from its diameter. Vertical agitation mixes to homogeneity in less time than other stirring modalities.

Figure 15A:
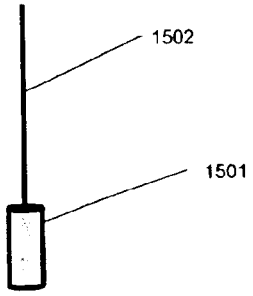
FIGS. 15A–15H are detailed views of stir bars in accordance with the present invention.

Referring now to FIGS. 15A–15H, a number of embodiments of preferred stir bars in accordance with the present invention are shown. In FIG. 15A, a coated or encapsulated (encased) magnet 1501 is shown with a straight small diameter rod 1502, which is preferably 1 to 3 mm diameter to form an extended stir bar. This rod 1502 may be round, flat, polygonal, or otherwise shaped in cross-section. Preferably, the rod 1502 is formed of an inert polymeric material. However, a metallic material could be utilized.

Figure 15B:
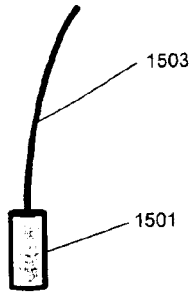

FIG. 15B shows an alternative embodiment of the stir bar, similar to FIG. 15A. In this embodiment, a curved rod 1503 is connected to the magnet 1501. In both FIGS. 15A and 15B, the small diameter rod provides enhanced stirring action in small diameter tubes (7–13 mm) with a depth greater than 20 mm. Because the stirring device rotates about its' own axis in addition to rotating around the magnetic poles the curved rod 1503 adds an additional dimension to the stirring action.

Figure 15C:
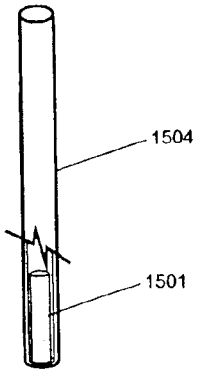

Referring now to FIG. 15C, another embodiment of a stir bar in accordance with the invention is shown. The stir bar includes the magnet 1501 encased in a straight tube 1504. The tube 1504 may be a solid material that is light enough to float such as closed cell foam or other material with a specific gravity less than 1. Preferably, the tube 1504 is formed of a polymeric material. This stir bar functions in a similar manner to the stir bar of FIG. 15A, but the larger diameter tube 1504 provides more stirring action. It also provides a buoyancy feature that allows its' use in larger containers, to provide vertical stirring without length to diameter restrictions.

Figure 15D:
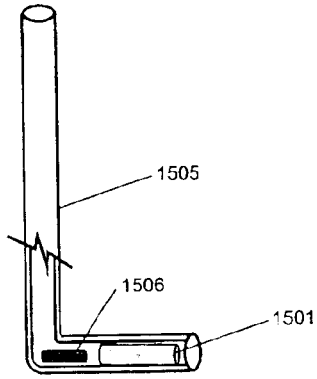

Referring to FIG. 15D, a shaped stir bar assembly in accordance with the invention is shown in detail. This stir bar utilizes a formed tube 1505 having a lower, generally horizontally extending leg, in which the magnet 1501 is preferably located, and a generally vertically extending leg connected thereto. A weight 1506 is optionally provided. The weight 1506 is required when the weight of the stir bar is not sufficient to keep the stir bar submerged near the bottom of the liquid container. One or more weights 1506 may be used. The positions of the weight(s) 1506 and the magnet 1501 may be in any order, which will change the action of the stir bar, thus the mixing dynamics will be different. Positioning the magnet 1501 at the end of the horizontal leg will pull the vertical leg around the liquid. Conversely, if the magnet 1501 is positioned near the bend, the horizontal leg will be pulled about behind the vertical leg. The magnet 1501 may also be positioned above the bend in proximity to the horizontal leg, again imparting a different stirring action to the stir bar and consequently a different mixing dynamic. The tube 1505 may be a solid material that is light enough to float such as closed cell foam or other material with a specific gravity less than 1, and is preferably made of a polymeric material.

Figure 15E:
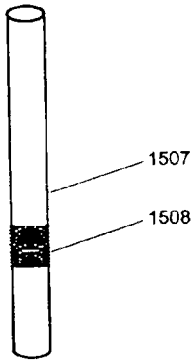
Figure 15F:
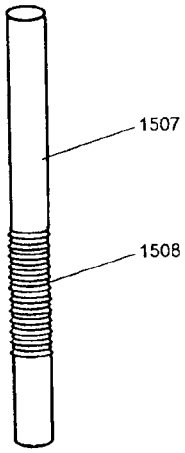
Figure 15G:
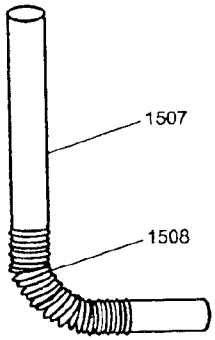

Referring now to FIGS. 15E–15H, variations of stir bars that can be made with a flexible element 1507 with a corrugated section 1508 are shown. The magnet and weight concepts are included in this stir bar, but are not illustrated. The flexible element is a corrugated section 1508 of the tubing. FIG. 15E shows the corrugated section 1508 in a collapsed position. FIG. 15F shows the corrugated section 1508 extended which can be used to produce a longer stir bar. FIG. 15G shows the corrugated section bent to produce an angled stir bar. The stir bar may be made of a solid material that is light enough to float such as closed cell foam or other material with a specific gravity less than 1. These variations provide the stirring actions of similar shapes as described above.

Figure 15H:
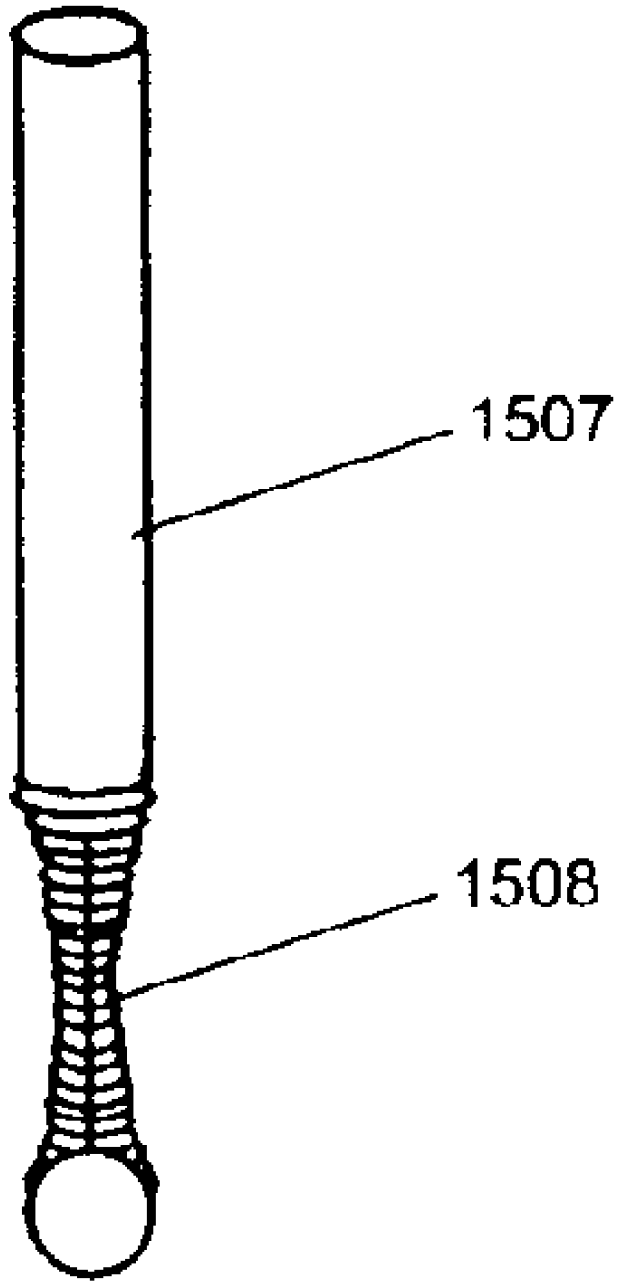

Referring to FIG. 15H, the corrugated section 1508 like all plastic parts has memory and will tend to relax a little bit after bending. To set the bend after the desired shape is made, the corrugated section is pinched or flattened as shown. The bend becomes quite ridged and remains fixed until it is re-formed.

While the basic variations of the stir bar in accordance with the present invention have been shown, those skilled in the art will recognize from the present disclosure other variations of the illustrations shown will provide different stirring actions. The stir bars in accordance with the invention may be manufactured in many different ways, such as cutting and bending, molding, heat crimping and sealing, as well as various other appropriate methods.

3. Electro-Magnetic Drives

Figure 5A:
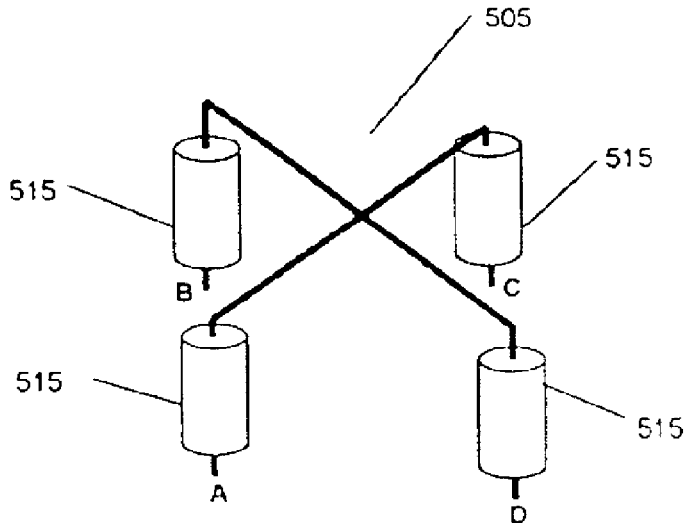
FIG. 5A shows series connected inductor coils used to produce magnetic fields in accordance with one embodiment of the present invention.
Figure 5B:
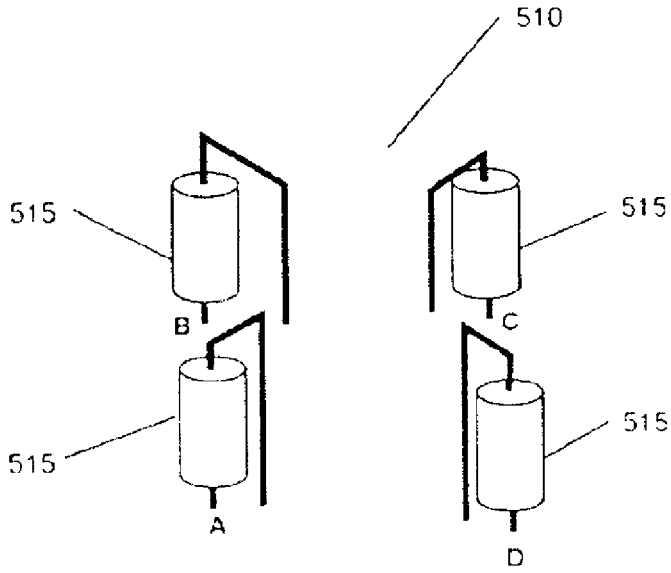
FIG. 5B shows individual inductor coils used to produce magnetic fields in accordance with one embodiment of the present invention.

The electromagnetic drive electronics and software can be configured and programmed in many ways. Any number of inductors may be used, for example, a single horizontal inductor with two extended cores or two or more inductors for various container shapes and applications. FIGS. 5A and 5B schematically represent variations of the coils and variations of the possible drive sequences for different stir bar dynamics. This device controls the strength, location, and the energizing sequence of the magnetic field. The magnetic drives may be electromechanical or fully electronic for precise stirring speed, dynamics and placement control. The magnetic drives positioned beside the container cause horizontal and vertical motion. The magnetic drives positioned below the container will repel or attract the stir bar, again inducing a horizontal and a vertical or lifting motion. Both of these add to chaotic stirring resulting in turbulent mixing. Larger volumes can be stirred by arranging the inductors in a number of concentric circles. The stir bar is moved about and between the inductors to induce stirring in all areas of the container and create more irregular chaotic patterns. These magnetic driving forces are preferably located below and or around the sides to pull the stir bar to the outer wall and corners.

The magnetic driving forces are positioned below and or around the sides of the container. There may also be several individual or sets of magnetic drives depending on the size of the container. They may also be positioned above the container where the stir bar would have the magnet positioned in the top of the stir bar. The sequencing of the drives creates various mixing patterns. The basic stirring action is comprised of two elements. One is a rotational and the second is a chaotic action caused by the stir bar becoming uncoupled from the magnetic drive or the sequencing of the magnetic drive. The drive variations can be stopping, reversing, random non-rotational movements or a combination of any or all of these. These chaotic stirring actions cause asymmetrical turbulence in the liquid.

The rotational motion creates currents that suspend particles and begin the mixing patterns of the liquid. The irregular and chaotic stirring element disrupts the stirring flow patterns creating turbulence and provides more complete mixing. The multiple inductors and chaotic action causes the stir bar to move to the center, corners and walls where regular mixing patterns are least efficient and disrupts the regular mixing patterns. The magnet drives as shown in this invention pull the stir bar side ways, limiting the downward forces that typical magnetic stirrers exhibit, which increase the mechanical forces and cause cellular or other fragile components in the liquid or sample to be altered, activated or physically compromised.

The inductor coil design is unique in that the length of the core piece extends beyond the length of the inductor coil in order to position the magnetic field beside the container and above the bottom of the container. The position of the coil core may be from the bottom of the container to the full height of the container depending on the application.

In every case complete mixing is accomplished at considerably lower speeds than with conventional stirring methods. Slower stirring is advantageous in that it reduces the instances and effects of mechanical forces of shear or cavitations, chiral or other vortices, and therefore does not alter, damage or activate the liquid or sample. This is especially important when stirring plant or animal cells or other organisms such as bacteria or viral specimens and proteins or long chain chemicals. Many cultured cells are not as robust as "natural" cells and the present invention addresses this problem by providing gentle stirring that is thorough due to the chaotic nature of the stirring.

A typical stirring sequence would be a rotational pattern that is less than the size of the container diameter. After a period when the liquid begins to flow in a circular pattern, usually seconds, the rotational motion is disrupted for a short period and then returned to a rotational pattern. This may be done by reversing, stopping, changing the set of drivers or changing the rotational speed. The bar will then move in a random pattern for a period by being attracted and repelled by the different magnetic forces. In larger volumes, the stir bar is moved about and between several concentric circles to induce stirring in all areas of the container, which disrupts the symetrical stirring patterns. Although the disrupted pattern is completely random, the pattern will include all of the areas that were not well mixed with conventional methods. The residual liquid flow also directs the stir bar into areas that were not mixing well. The flow of the liquid and the rotating magnetic fields will eventually overcome the random motion to return the stir bar to the rotational pattern until that pattern is disrupted again.

Figure 13:
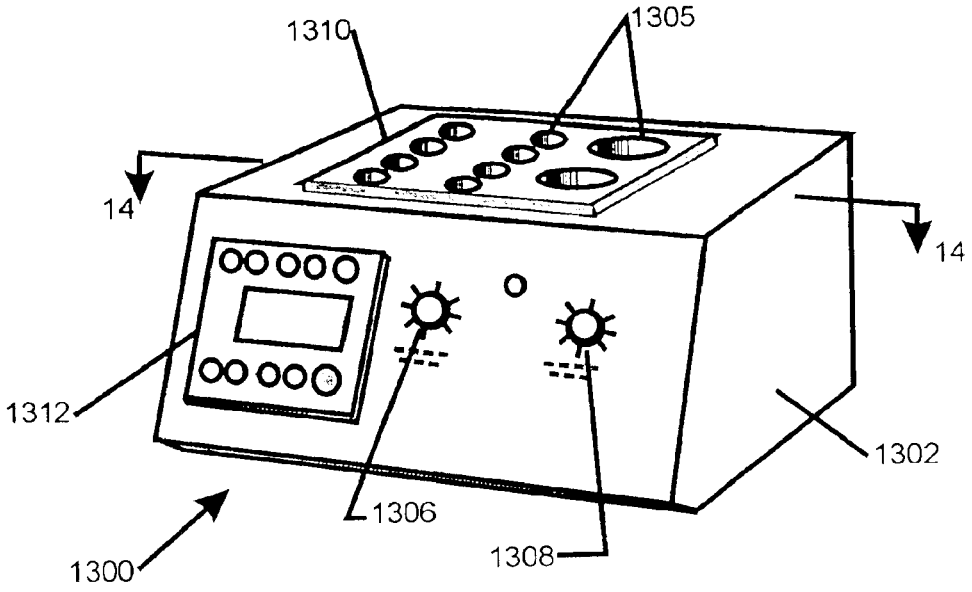
FIG. 13 is a perspective view of a stirrer in accordance with the invention.
Figure 14:
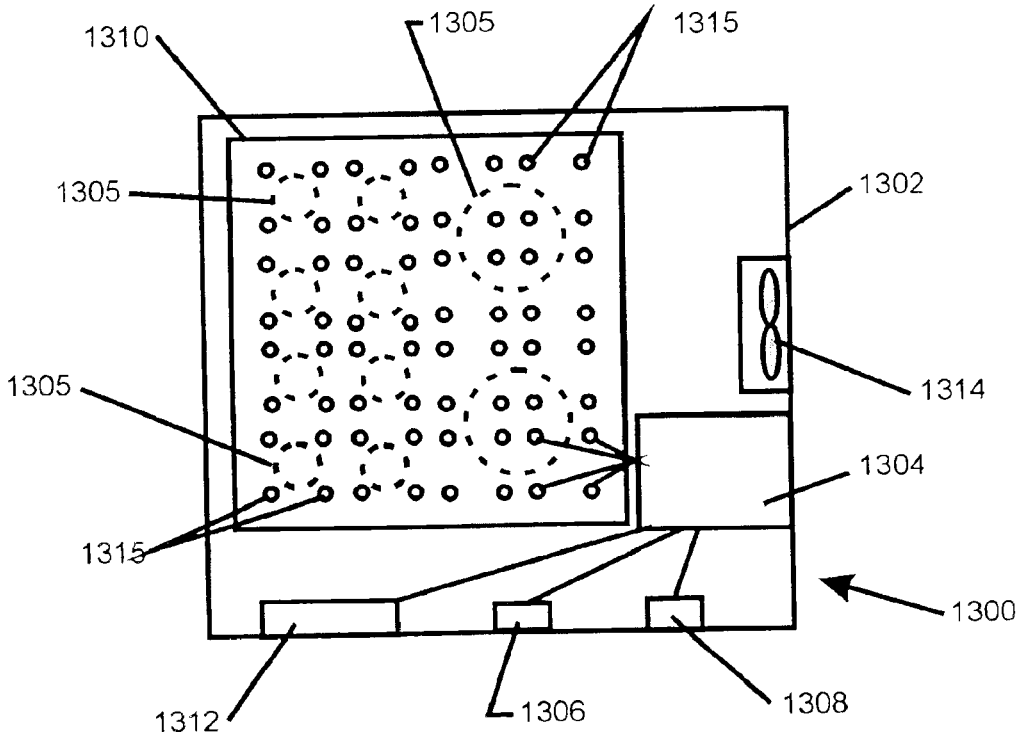
FIG. 14 is a view of the inductors and the internal components of the stirrer, represented schematically, taken along line 14—14 in FIG. 13.

The magnetic drives can be positioned and sequenced in patterns that change the position of the stir bar to mix in various areas of the container, establishing mixing patterns, then move to a different position where other conflicting patterns are established, which cause turbulence within the liquid. This can be repeated until complete mixing has been achieved. The possible variations are endless and can be customized for the materials and container in use. While four magnetic drives have been illustrated, more could be provided, and the drives can be arranged in generally concentric circles for larger containers, such that the stir bar is moved inwardly and outwardly in different sized circles or can be moved back and forth in various paths to completely mix the liquid in the container in a random and chaotic manner. Additionally, it is possible to provide an array of magnetic drives on a stirring device, such as shown in FIGS. 13 and 14, with one or more of the drives in different areas being commonly controlled, so that, for example, six different containers could all be mixed at the same time using the same or different sequencing for energizing one or more groupings of the magnetic drives at the container wells, which may be located in a holder or are preferably defined in an incubation block as described in more detail below. Additionally, the stirring device can be adapted to receive known types of incubation blocks for different sizes of containers, with the array of magnetic drives being programmable so that the magnetic drives can be controlled based on the location, size and number of containers being used.

The inductors can be used to position the stir bar to one side or synchronizing the stir bar, allowing a photo optical measurement to be made through the material. Normally the optical path must be above the stir bar and at times the stir bar would interfere with the optical path due to bouncing or lofting. The ability to position the stir bar can also be used to provide room for a sampling probe to be inserted into the material.

The inductors may be energized much like a stepper motor is driven. Different drive sequences will provide different stirring dynamics. Unlike a motor or mechanical drive, the sequence and stirring patterns can be programmed in many ways and are much more precise in their application. The motion is not continuous like a spinning magnet but instead point to point (inductor to inductor) which induces irregularities to the motion of the stir bar and results in infinite control of the stir bars.

FIG. 5A shows a circuit 505 including four inductor coils 515 positioned generally equally spaced. The inductor coils 515 are placed around a well that holds a container of liquid material to be stirred. Two pairs of opposing inductor coils 515 are connected in series.

The sequence of energizing each pair of inductor coils is:

(1) Pair one (A-C) is energized in a forward direction and pair two (B-D) is not energized;

(2) Pair one (A-C) is not energized and pair two (B-D) is energized in a forward direction;

(3) Pair two (B-D) is not energized and pair one (A-C) is energized in the reverse direction; and (4) Pair one (A-C) is turned off and pair two (B-D) is energized in the reverse direction.

Sequence (1) through (4) above will turn the magnetic stir bar one revolution. This sequence is repeated as required to rotate the stir bar at the speed desired. In a preferred embodiment for vertical stirring of a 0.5 ml container, the stir bar can be driven at about 20 to 200 steps per minute in order to produce the equivalent of approximately 5 to 50 revolutions (or combinations of revolutions and random sequences, with a revolution being equivalent to 4 steps) per minute for gentle mixing. A particularly preferred range is 40 to 100 steps per minute, to produce 10 to 25 rpm In contrast, a prior art stirrer with a horizontal magnetic stir bar is generally driven at 1200 rpm, which is orders of magnitude faster and which causes high shear stress, eddy currents and vortex mechanisms. Of course higher or lower stepping speeds can be used to achieve the desired mixing depending upon the particular application, the container size and the stir bar configuration.

Additional inductor coils may be included to achieve various patterns and stirring dynamics. For example, in a one liter container, twelve inductor coils can be arranged in two generally concentric rings. The stir bar is preferably driven at 100 to 300 steps per minute to produce the equivalent of about 16 to 50 large or small revolutions (a small revolution having 4 steps, a large revolution having 8 steps, and random sequences—with 6 steps being considered comparable to one revolution) per minute for gentle mixing. Higher or lower speeds can be utilized depending on the application.

An inductor coil located directly below the well where the container is located can cause the vertical stir bar to be repelled up and attracted down in the container while the stir bar is rotating. The inductor coils may be energized much like a stepper motor is driven. Different drive sequences will provide different stirring patterns. If the four inductor coils 515 are energized individually, the stir bar will be indexed around the container either in a circular or crossing pattern.

FIG. 5B shows a circuit 510 including four inductor coils 515, which are energized on an individual basis. The stir bar is indexed around the container either in a circular or crossing pattern. A circular or rotating pattern will suspend particles and begin a flow pattern of the liquid. Deviating from this initial stirring pattern creates turbulence and chaotic mixing. Additional inductor coils could be used, depending on the particular application.

Magnetic repulsion is another method of disrupting the flow patterns of the liquid. The stir bar is repelled by a magnetic force causing a vertical motion. An inductor coil located directly below the well where the container is located causes the vertical stir bar to be repelled up and then attracted down in the container while the stir bar is rotating. This stir bar may include flanges or arms used to produce the vertical stirring patterns. In small tubes, a cylindrical stir bar moving in a vertical motion through the liquid mixes the materials faster than a rotary motion. The magnetic force can be modulated to control the distance the stir bar is repelled, i.e., below or through the liquid surface (meniscus) and eliminating surface tension constraints on mixing. The vertical movements of the stir bar avoids vortexing artifacts and is a gentle method of mixing this region.

As shown in FIGS. 6A and 6B, when a pair of inductor coils 515 of FIG. 5 are energized, one core piece is a positive polarity and the other core piece is a negative polarity. This arrangement causes the magnetic stir bar to be attracted at both ends, resulting in doubling the coupling force.

FIGS. 7A and 7B show the polarities of current applied to the inductor coils 515 of FIGS. 5A and 5B at half step rotational angles to create magnetic fields in accordance with the present invention.

FIG. 8 shows the sinusoidal drive of the inductor coils 515 of FIGS. 5A and 5B used to create magnetic fields in accordance with the present invention.

Figure 9:
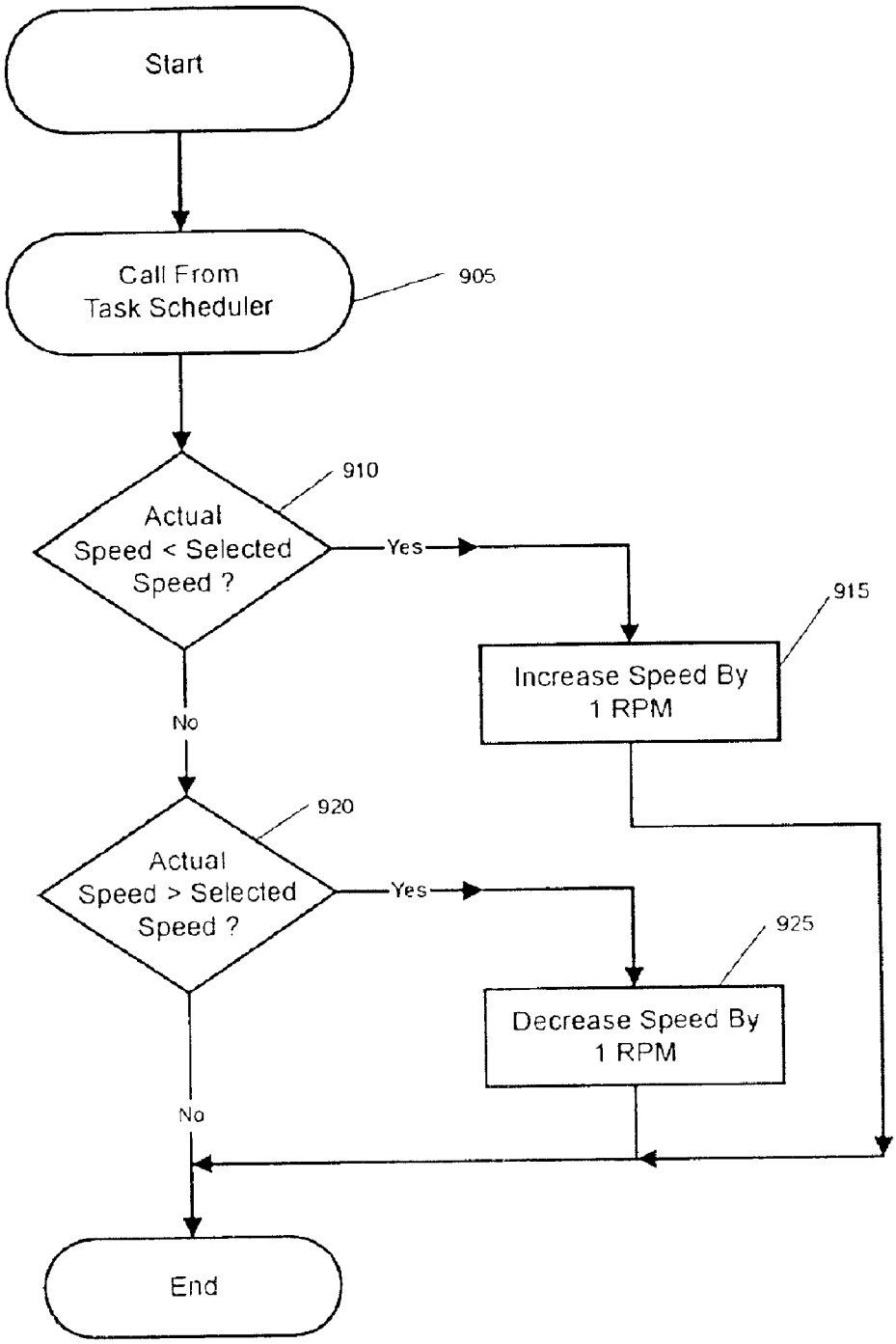
FIG. 9 is a flow chart which shows how the inductor coils are sequentially activated in accordance with the present invention.

FIG. 9 shows how the inductor coils 515 of FIGS. 5A and 5B are sequentially activated in accordance with the present invention. The activation of inductor coils 515 is preferably controlled by a processor (e.g., a microprocessor) capable of executing nearly 300,000,000 individual instructions each minute. However, those skilled in the art will recognize that other types of controllers may be used in the present invention. The coil sequencing is performed at a much slower rate. The advancement of this sequence is controlled by firmware. The inductor coils 515 are energized in a circular pattern. A software counter/divider is used to slow the pace of instruction execution to the desired rotational rate of coil phasing.

FIG. 9 shows a series of method steps implemented by a ramping algorithm to control the rotational speed of a stirrer. If the rotational rate is changed, the actual rate is gradually changed until it is equal to the selected rate. A task scheduling routine periodically calls the ramping algorithm (step 905). If the actual rotational speed is determined to be less than the selected speed (step 910), the rotational speed is increased by one RPM (step 915). If the actual rotational speed is determined to be greater than the selected speed (step 920), the rotational speed is decreased by one RPM (step 925). If the actual rotational speed is equal to the selected speed, the rotational speed is not changed. In one preferred embodiment, the maximum rate of change is 15 seconds from 10 RPM to 1400 RPM.

Because there is no physical mass to the stirring mechanism (the rotating magnetic fields), a change in rotational speed is instantaneous. This could result in de-coupling between the rotating magnetic fields and the magnetic stirring bar. With biological solutions, a rapid change of speed will cause damage to the cells or proteins. In the case of higher viscosity solutions, the stir bar will de-couple due to the restriction (drag) of the solution. The ramp up of speed ensures the stirrer remains captured by the electromagnetic fields. In order to ease the transition from one selected rotational speed to another, a method of gradually changing the rotational speed is employed called 'ramping'. Ramping is the gradual changing of the counter/divider load value described above. When a change in selected rotational speed is detected, the counter/divider load value is gradually altered until it stops at the value required for the newly selected rate. A pre-selected rate of change (RPM/second) is selected to suit the application. The Drive voltage/current may be adjusted to provide gentler or stronger stirring action. This expands the range of viscosities that can be stirred and reduces the stress on fragile cells or molecules.

4. Simulator

Figure 10A:
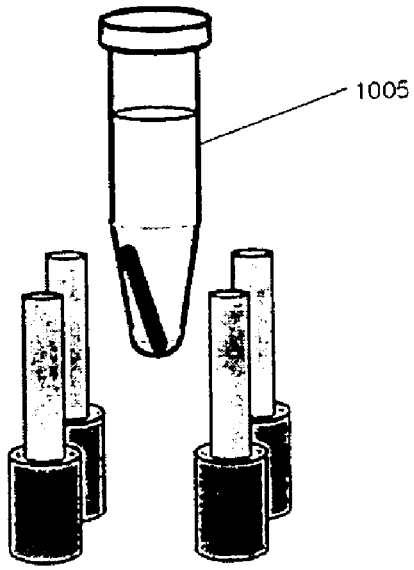
FIGS. 10A and 10B show a perspective view of a simulator used to develop effective stirring dynamics in accordance with one embodiment of the present invention.
Figure 10B:
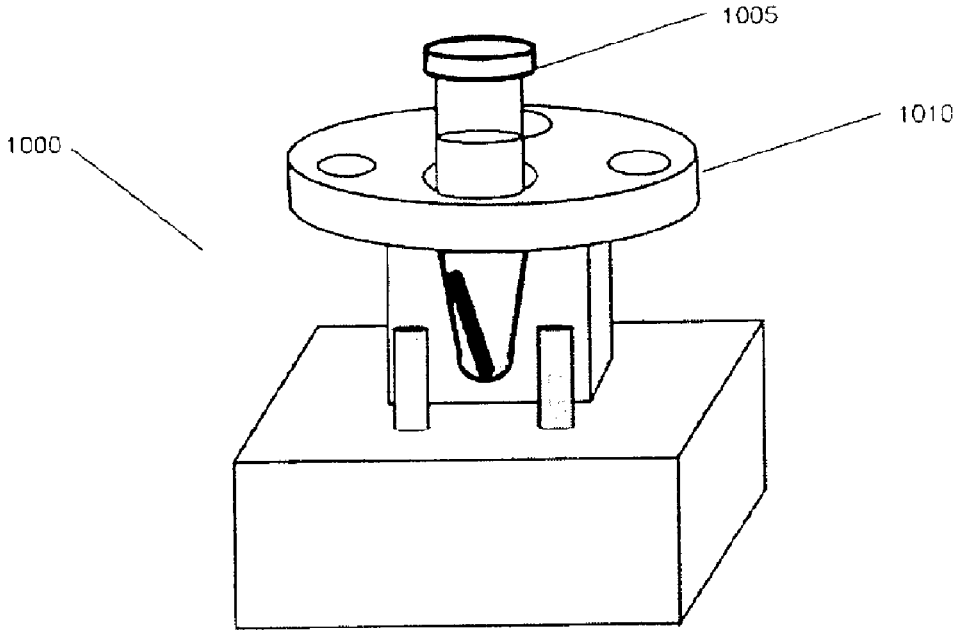

FIGS. 10A and 10B show an auxiliary component of the stirring system—the Simulator. Stirring in an incubation block 1110 cannot be observed which contributes to the problem of conventional stirring. Typically, the effectiveness of the stirring is assumed. The Simulator allows the direct observation of stirring modalities and development of application specific mixing processes. The Simulator is a replication of the magnetic stirring drive with a container 1005 and a container holding attachment 1010. The Simulator 1000 produces the identical stirring speed and dynamics as occur in the main device. The container 1005 is held in a manner that allows the visual observation and assessment of the stirring dynamics.

Selecting a stir bar for the micro-container and liquid combination can only be optimized and documented with the use of the Simulator 1000. The optimization process is accomplished by:

(1) Filling the container 1005 with the liquid to the proper volume to be stirred.

(2) Adding to the liquid a small amount of particles, such as latex beads, or a colored liquid, or fluorescent dyes to improve visualization. This material may be added prior to or during the stirring.

(3) Select a stir bar and place it into the container 1005. For certain studies such as those for bio-compatibility this may require specific coating materials for the stir bar.

(4) Depending on the type of stirring effect desired, set the speed control to the lowest speed where mixing is observed to be complete. Place the container 1005 into the container holder 1010 of Simulator 1000.

(5) Observe the mixing until the dynamics are constant. Increase the stir speed until the desired dynamics are achieved.

(6) If the dynamics are not effective, change the stir bar size or shape or the container size or shape and repeat the process.

(7) Once an effective stirring dynamic has been determined, the process should be applied to the actual materials in the main incubation block 1110 and the process verified. This process will ensure the effectively, reproducibility and reliability of the specific mixing processes.

5 Temperature Control

Figure 11A:
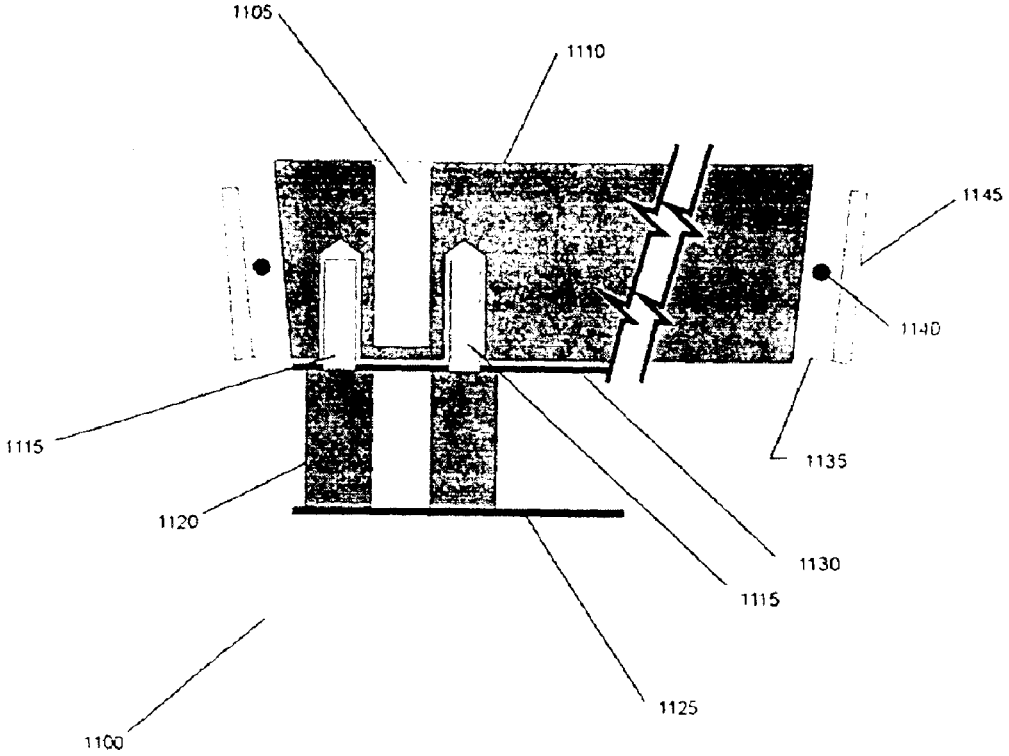
FIGS. 11A and 11B shows details of the assembly of a temperature control system in accordance with two embodiments of the present invention.
Figure 11B:
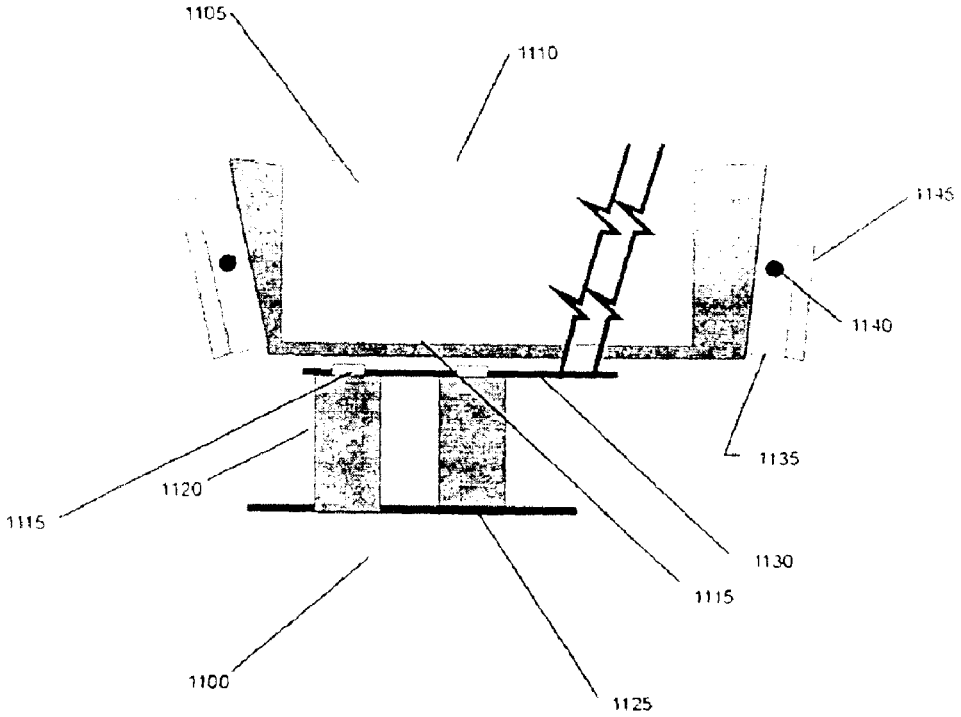

FIG. 11A shows an electromagnetic stirring device 1100 used in accordance with the present invention in which the inductors 1115 extend into the incubation block in locations around the container well 1105. FIG. 11B shows a modification for larger volume application such as beakers and flasks, in which some or all of the inductors 1115 remain below the container. A sample to be stirred sits in a container placed in a container well 1105. Electromagnetic inductors 1115 and are located below an incubation block 1110. A non-magnetic coil plate 1130 is in contact with extended cores 1120 of electromagnetic inductors 1115. This coil plate 1130 transfers heat to the incubation block 1110 and acts as a heat sink to cool the electromagnetic coils 1120 when the fan is activated. The extended cores 1115 efficiently transfer inductor heat into the incubation block 1110. The electromagnet coils 1120 are mounted on a printed circuit board (PCB) 1125.

There are one or more fans located at one side of the space between the PCB 1125 and the non-magnetic coil plate 1130. The space between the PCB 1125 and the plate acts as an air duct.

The temperature control has two main elements.

(1) Heat sources: the electromagnetic coils 1120 and a heater plate 1135.

(a) Heater plate 1135 rotates on a pivot pin 1140 and includes insulation 1145.

(b) The electromagnetic coils 1120 are positioned in a regular pattern below the interchangeable incubation block 1110 to be heated.

(2) Cooling control of the electromagnetic coils 1120.

(a) A cooling device or fans are used to control the heat provided to the incubation block 1110 by the electromagnetic coils 1120.

(b) Cooling is achieved by creating airflow across the electromagnetic coils 1120 and coil plate 1130.

There are two control systems, one for the heaters and a second for the incubation block 1110. Fans, regulating the temperature of the electromagnetic coils 1120 and controlling the amount of heat transferred to the incubation block 1110 control the incubation block temperature. The control systems provide a ramping function for the warm up cycle that is rapid and slows as the temperature set point is reached. The heating and cooling combination provides the same temperature control as maybe provided with a proportional temperature controller. The resulting temperature control is very accurate, stable and uniform.

Figure 12:
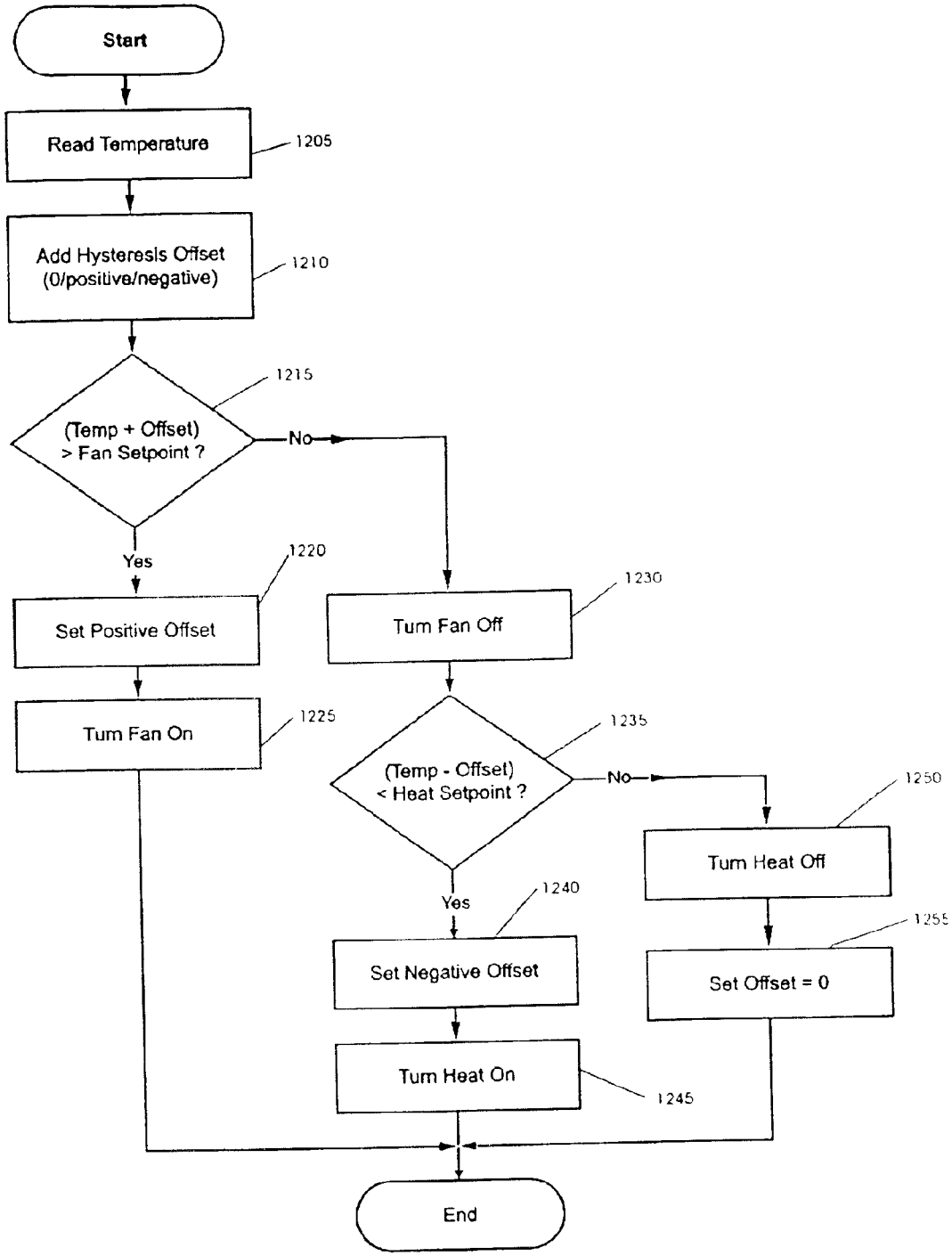
FIG. 12 is a flow chart, which shows how temperature of liquid material stirred by the present invention is controlled in accordance with the present invention.

FIG. 12 is a flow chart illustrating the temperature control process of the present invention. When the power is applied, an algorithm is executed every 1.0 milliseconds.

Temperature control of the incubation block is comprised of heater and fan control circuits and algorithms which operate independently of each other. A common setpoint for each selected temperature is shared.

There is a point of equilibrium for the block temperature of about 40 degrees centigrade. The actual point of equilibrium is dependent on the amount of heat generated and dissipated by the device, the ambient room temperature, and air currents within the room.

At temperatures below this equilibrium point the device will self heat from stirring coil dissipation. The heaters are used only to increase the temperature more quickly to the setpoint. The fans keep the unit cooled to the selected temperature.

At temperatures above this equilibrium point, the fans play a decreasing role while the heaters play an increasingly larger role in maintaining temperature.

(1) Fan Control

The fans are controlled by a variable duty-cycle algorithm (see steps 1205, 1210, 1215, 1220, 1225, 1230). When the block temperature rises above the setpoint, the fan is turned on for a minimum of 20 seconds. This delay eliminates the need for hysteresis, which would be necessary prevent excessive on/off cycles of the fan. By design, hysteresis would add more variation in the controlled temperature. Its elimination then provides for a more accurately controlled block temperature.

At the end of the 20 second delay period, the block temperature again is compared to the setpoint and the process is repeated until the block temperature is below the selected setpoint.

(2) Heater Control

The heaters are also controlled by the variable duty-cycle algorithm (see steps 1235, 1240, 1245, 1250, 1255). The amount of time the heater is turned on during the cycle is directly proportional to the difference between the selected and actual block temperature. This method provides a fast rise time to a newly selected temperature while also preventing temperature overshoot.

Each selected temperature has a setpoint and a cycle time. The cycle time is the total combined "on" and "off" times in seconds. The "on" time is calculated as described above. The heater "off" time is equal to the cycle time minus the heater "on" time. The cycle times become shorter as the selected temperature is increased as more heating is required to maintain the higher temperatures.

The incubation block temperature rises initially and as the set point is reached the rate of temperature rise slows down. The heat of the electromagnetic inductors distributed across the bottom of the incubation block 1110, causes vertical heat gradient patterns within the incubation block 1110. A temperature sensor embedded in the incubation block 1110 senses the temperature set point and begins the modulation of the temperature. This control gradually reduces the rate of the temperature rise throughout the warm up cycle. The rate of temperature rise of the incubation block 1110, from the bottom to the top, assists in the modulation of the temperature.

The ability to input heat and remove heat provides greater control than heaters alone. The cooling rate and dynamics can be enhanced with the application of solid state heat pumps, Peltier devices or chilled heat sinks to supply incubation block temperatures below ambient temperature Such an addition would find application in the areas of thermal cycling or to remove heat developed during the process as in bioreactors, fermentation or combinational chemistry.

6 Stirrer

Preferably, some or all of the above features are incorporated into a stirrer 1300 having a plurality of electromagnetic inductors 1315 that can be below or extend into an incubation block 1310 having a plurality of container wells 1305 (shown with broken lines in FIG. 14), depending upon its configuration. The wells 1310 can be of the same or different sizes, and preferably different incubation blocks 1310 can be placed in an opening in the stirrer housing 1302. The controller 1304 is also located in the housing 1302 and is connected to a speed control 1306 and a temperature control 1308, which may be rotary or electronic switches that are set by a user. Alternatively, these could be programmed through a key pad connected to the controller 1304. Preferably, a timer 1312 is also connected to the controller 1304 to control specific mixing times. Additionally, it is also possible to pre-program the controller 1304 with separate energizing sequences that can be selected dependent upon a particular application. Allowing user programming of energizing sequences to cause specific movement paths for the stir bar for chaotic and random mixing developed for particular applications can be provided through a key pad or other data entry device. The controller 1304 is connected to the inductors 1315 to preferably allow individual programmable control of each inductor 1315. Alternatively, groups of inductors 1315 can be controlled together.

A fan unit 1314 is preferably connected to a thermostat (not shown) and the controller 1304 in order to control the temperature of the incubation block 1310. As previously noted, a separate heater can also be provided to provide additional heating if the heat dissipated by the electromagnetic inductors 1315 is not sufficient for heating to the desired temperature. As shown in FIG. 14, the inductors 1315 are preferably arranged in an array, and can be selectively actuated by the controller to provide identical or different energizing sequences for stirring to multiple containers located in different wells 1305. Preferably, energizing sequence programs can be stored in the controller 1304 so that they are repeatable which will provide some measure of uniformity for benchmarking or calibration testing that require generally the same amount of chaotic stirring for each sample.

The stirrer 1310 allows the stirring of materials with low shear and stress on materials being mixed, and operates at reduced stirring speeds and shorter mixing cycles in order to achieve complete mixing as compared to the prior known devices. Additionally, the same stirring method and dynamics can be applied from microliter to liter volumes or greater, using the same stirrer 1310 with minimal process changes.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

What is claimed is:

1. A method of producing chaotic mixing to effect an entire volume of a liquid in a container, comprising:

inserting a magnetic stir bar into the container so that it is generally vertically oriented, the stir bar having a length greater than an internal diameter of the container or one half of a depth to greater than the depth of the liquid in the container;

creating an erratic stirring pattern of the stir bar in the liquid by separately activating a plurality of magnetic fields to act on the stir bar in one or more dimensions, wherein the plurality of magnetic fields are formed by a plurality of controllable magnetic drives located in proximity to the container, and the method further comprises changing an energizing sequence of the magnetic drives by at least one of stopping, reversing, and random sequencing of the energizing sequence to create chaotic and gentle mixing action of the liquid movement of the stir bar.

2. The method of claim 1, further comprising applying the at least one magnetic field to cause generally vertical up and down movement of the stir bar.

3. The method of claim 1, wherein the energizing sequence is stored in a controller and is repeatable.

4. The method of claim 1, wherein the energizing sequence can be programmed for at least one of a particular container size or a particular type of liquid being mixed.

5. The method of claim 1, wherein the energizing sequence first causes the stir bar to create a first flow pattern in the liquid, and then changes the movement of the stir bar to interrupt the first flow pattern causing turbulence.

6. The method of claim 1, further comprising providing the magnetic drives as inductor cores which extend from fixed inductor coils into proximity with the container.

7. The method of claim 1, wherein four magnetic drives are provided for the container arranged as opposing pairs, the energizing sequence comprises:

energizing pair one (A-C) in a forward direction and not energizing pair two (B-D);

energizing pair two (B-D) in the forward direction and not energizing pair one (A-C);

energizing pair one (A-C) in a reverse direction and not energizing pair two (B-D); and energizing pair two (B-D) in the reverse direction and not energizing pair one (A-C) to turn the stir bar one revolution.

8. The method of claim 1, wherein four magnetic drives are provided for the container and the magnetic drives are selectively energized.

9. The method of claim 1, wherein the magnetic drives are energized so that the stir bar is rotated at a speed of at least 10 rpm.

10. The method of claim 1, further comprising providing the stir bar with an L-shape.

11. The method of claim 1, further comprising providing the stir bar having at least one end that is lighter than the liquid that is being stirred so that the stir bar stands generally vertically and/or is suspended in the liquid.

12. The method of claim 1, wherein the magnetic fields are formed by a plurality of controllable magnetic drives located in proximity to the container, and the method further comprising heating the container and the liquid therein using heat dissipated by the magnetic drives.

13. A stirrer for chaotic stirring that affect an entire volume of a liquid in a container, comprising:

a plurality of magnetic drives located in a housing;

a controller that selectively actuates the magnetic drives in accordance with an actuating sequence;

a holder for the container located on the housing in proximity to the magnetic drives; and a magnetic stir bar having a height greater than an internal diameter of the container or one half of a depth to greater than the depth of the liquid located in the container, the magnetic stir bar is generally upright and moves in response to the magnetic drives being actuated to chaotically stir the liquid in the container wherein the plurality of magnetic drives form a plurality of magnetic fields, and a changing energizing sequence of the magnetic drives by at least one of stopping, reversing, and random sequencing of the energizing sequence changes the plurality of magnetic fields, which impart movement on the stir bar, which imparts chaotic and gentle mixing action of the liquid.

14. The stirrer of claim 13, wherein the magnetic drives comprise inductor coils and inductors arranged in a fixed array, the inductor coils being individually energized by the controller.

15. The stirrer of claim 13, further comprising a coil plate to transfer heat from inductors of the magnetic drives to the holder, and a thermostat and a fan located in the housing for temperature control of the container and holder.

16. The stirrer of claim 13, wherein the holder is an incubation block.

17. The stirrer of claim 13, further comprising an opening in the housing above the magnetic drives in which the holder is inserted, which is adapted to receive a plurality of holders having different configurations.

18. The stirrer of claim 13, further comprising a manual speed control connected to the controller.

19. The stirrer of claim 13, wherein the stir bar is L-shaped.

20. The stirrer of claim 19, wherein a horizontal leg of the L-shaped stir bar has a length less than ¾ of the internal diameter.

21. The stirrer of claim 13, wherein the stir bar includes at least one end that is lighter than the liquid that is being stirred so that the stir bar stands generally vertically and/or is suspended in the liquid.

22. The stirrer of claim 13, wherein the stir bar has at least one of an asymmetrical shape, an eccentric weight, ribs or flutes.

23. The stirrer of claim 13, wherein the stir bar comprises a permanent magnet located in one end of a sealed polymeric tube.

24. The stirrer of claim 13, wherein the stir bar has at least three generally flat sides.

25. The stirrer of claim 13, further comprising a mixing simulator connected to the stirrer that includes a plurality of magnetic drives positioned to allow observation of a simulator container during mixing, the simulator magnetic drives being driven by the controller according to the same actuating sequence of the stirrer magnetic drives.

26. The stirrer of claim 13, wherein the magnetic drives include inductor coils and electromagnetic inductors that extend from the coils into proximity of the container.

27. The stirrer of claim 26, wherein the electromagnetic inductors extend into openings defined in the holder in positions located around sides of the container location.

28. A magnetic stir bar adapted to be oriented generally vertically in a container of liquid to be stirred, consisting of, a permanent magnet located at one end of a polymeric L-shaped member, wherein the polymeric member has one generally horizontally extending leg that is adapted to be on a bottom of the container, the magnet being located on within or in proximity to the horizontally extending leg.

29. The magnetic stir bar of claim 28, wherein the polymeric L-shaped member is flexible.

30. The magnetic stir bar of claim 28, wherein the polymeric L-shaped member is a tube, and the permanent magnet is sealed inside the tube.

31. The magnetic stir bar of claim 28, wherein the stir bar has at least one end that is lighter than the liquid that is to be stirred so that the stir bar stands generally vertically and/or is suspended in the liquid.

32. The magnetic stir bar of claim 28, wherein the stir bar has at least one of an asymmetrical shape, an eccentric weight, ribs or flutes.

33. A method of producing chaotic mixing to effect an entire volume of a liquid in a container, comprising:

inserting an L-shaped magnetic stir bar into the container so that it is generally vertically oriented, the stir bar having a length greater than an internal diameter of the container or one half of a depth to greater than the depth of the liquid in the container;

creating an erratic stirring pattern of the stir bar in the liquid by separately activating at least one magnetic field to act on the stir bar in one or more dimension.

34. A stirrer for chaotic stirring that affect an entire volume of a liquid in a container, comprising:

a plurality of magnetic drives located in a housing;

a controller that selectively actuates the magnetic drives in accordance with an actuating sequence;

a holder for the container located on the housing in proximity to the magnetic drives; and an L-shaped magnetic stir bar having a height greater than an internal diameter of the container or one half of a depth to greater than the depth of the liquid located in the container, the magnetic stir bar is generally upright and moves in response to the magnetic drives being actuated to chaotically stir the liquid in the container.

35. The stirrer of claim 34, wherein a horizontal leg of the L-shaped stir bar has a length less than ¾ of the internal diameter.

36. The stirrer of claim 34, wherein the stir bar includes at least one end that is lighter than the liquid that is being stirred so that the stir bar stands generally vertically and/or is suspended in the liquid.

* * * * *